US005898349A

United States Patent [19]

Hattori et al.

[11] Patent Number: 5,898,349

[45] Date of Patent: Apr. 27, 1999

[54] DIELECTRIC FILTER HAVING A PLURALITY OF TM MULTI-MODE DIELECTRIC RESONATORS

[75] Inventors: Jun Hattori; Hiroyuki Kubo, both of Takatsuki; Masamichi Andoh, Nagaokakyo, all of Japan

[73] Assignee: Murata Manufacturing Co., Ltd., Japan

[21] Appl. No.: 08/882,283

[22] Filed: Jun. 25, 1997

[30] Foreign Application Priority Data

Jun. 25, 1996 [JP] Japan ..... 8-164573
May 28, 1997 [JP] Japan ..... 9-138302

[51] Int. Cl.[6] ..... H01P 1/20; H01P 7/10

[52] U.S. Cl. ..... 333/202; 333/219.1; 333/134

[58] Field of Search ..... 333/202, 219, 333/219.1, 126, 134

[56] References Cited

U.S. PATENT DOCUMENTS 5,680,080 10/1997 Nishiyama et al. ..... 333/202
5,684,438 11/1997 Cavalieri D'Oro et al. .... 333/219.1 X

FOREIGN PATENT DOCUMENTS 0336255 10/1989 European Pat. Off. .
661770 7/1995 European Pat. Off. ..... 333/202
0759645 2/1997 European Pat. Off. .
5-48305 2/1993 Japan ..... 333/202

OTHER PUBLICATIONS

Patent Abstracts of Japan, vol. 96, No. 7, Jul. 31, 1996, JP 8-65005 A (Murata Mfg. Co., Ltd.), Mar. 8, 1996.
Patent Abstracts of Japan, vol. 96, No. 4, Apr. 30, 1996, JP 7-336103 A (Murata Mfg. Co., Ltd.), Dec. 22, 1995.
European Serach Report dated Nov. 2, 1998.
Singapore Search Report dated Oct. 13, 1998.

*Primary Examiner*—Seungsook Ham
*Attorney, Agent, or Firm*—Ostrolenk, Faber, Gerb & Soffen, LLP

[57] ABSTRACT

A dielectric filter exhibiting excellent filter characteristics in which the manufacturing cost is reduced by forming coupling loops for dielectric resonators generally in the same shape. First through fourth TM double-mode dielectric resonators are aligned in a row with their openings facing in the same direction. First and second metallic panels are screwed to the resonators to cover their openings. An input loop and an output loop are mounted on the first panel in such a manner that they obliquely face the intersecting areas of the respective dielectric members of the first and fourth dielectric resonators, respectively. Also attached to the first panel are generally "V"-shaped coupling loops. Also disclosed is a dielectric duplexer constructed of a plurality of such dielectric filters.

22 Claims, 4 Drawing Sheets

$TM_{110}^{X+Y}$ $TM_{110}^{X-Y}$ $TM_{110}^{X}$ $TM_{110}^{Y}$

DIELECTRIC FILTER HAVING A PLURALITY OF TM MULTI-MODE DIELECTRIC RESONATORS

BACKGROUND OF THE INVENTION

1. Field of the Invention

The present invention relates to a dielectric filter and a dielectric duplexer using TM multi-mode dielectric resonators.

2. Description of the Related Art

Hitherto, TM double-mode dielectric resonators with cross-shaped dielectric members disposed in a cavity having a conductor on its outer surface have been used in a bandpass-type dielectric filter. An example of this type of dielectric filter is shown in FIG. 6.

Referring to FIG. 6, a dielectric filter generally designated by 101 has four TM double-mode dielectric resonators 102, 103, 104 and 105 aligned in a row with their openings facing in the same direction, and metallic panels 106 and 107 to cover the openings of the resonators 102 through 105.

The dielectric resonator 102 is constructed in the following manner. A cavity 102*a* having openings at its forward and back ends and a cross-shaped dielectric member 102XY are integrally formed of the same dielectric material. Further, a conductor 102*b* is disposed on the outer surfaces, except for the openings, of the cavity 102*a*. The dielectric member 102XY is formed of a horizontal dielectric portion 102X and a vertical dielectric portion 102Y, so that the single TM double-mode dielectric resonator 102 can form a two-stage resonator. The TM double-mode dielectric resonators 103, 104 and 105 are constructed in a manner similar to the above-described dielectric resonator 102.

An input loop 108 and an output loop 109 are attached to the panel 106 and connected to an external circuit via a coaxial connector (not shown). Fixed to the panel 107 are coupling loops 107*a*, 107*b*, 107*c* and 107*d* each for coupling adjacent dielectric resonators.

The operation of the dielectric filter 101 constructed as described above will now be explained. High-frequency power is first supplied to the dielectric filter 101 to magnetically couple the input loop 108 and the vertical dielectric portion 102Y serving as a first-stage resonator. Due to this magnetic coupling, the TM110Y mode shown in FIG. 7B is excited in the vertical dielectric portion 102Y, and is then electromagnetically coupled within the dielectric member 102XY to the horizontal dielectric portion 102X used as a second-stage resonator. Accordingly, a TM110X mode illustrated in FIG. 7A is further excited in the horizontal dielectric portion 102X, and is then magnetically coupled to the coupling loop 107*a*.

The coupling loop 107*a* opposedly faces not only the horizontal dielectric portion 102X used as the second-stage resonator, but also the horizontal dielectric portion 103X serving as a third-stage resonator. Thus, the coupling loop 107*a* magnetically coupled to the horizontal dielectric portion 102X is further magnetically coupled to the horizontal dielectric portion 103X. Because of this coupling, the TM110X mode shown in FIG. 7A is excited in the horizontal dielectric portion 103X, and is further electromagnetically coupled within the dielectric member 103XY to the vertical dielectric portion 103Y used as a fourth-stage resonator. Due to this coupling, the TM110Y mode illustrated in FIG. 7B is excited in the vertical dielectric portion 103Y, and is then magnetically coupled to the coupling loop 107*b*.

The coupling loop 107*b* is connected to the coupling loop 107*c*, and as in the case with the loop 107*b* opposedly facing the vertical dielectric portion 103Y as the fourth-stage resonator, the loop 107*c* opposedly faces the vertical dielectric portion 104Y used as a fifth-stage resonator. Accordingly, the loop 107*b* magnetically coupled to the vertical dielectric portion 103Y is further magnetically coupled to the vertical dielectric portion 104Y via the coupling loop 107*c*.

Thereafter, in a manner similar to the above procedure, the vertical dielectric portion 104Y is electromagnetically coupled to the horizontal dielectric portion 104X serving as a sixth-stage resonator. The horizontal dielectric portion 104X is further magnetically coupled via the coupling loop 107*d* to the horizontal dielectric portion 105X used as a seventh-stage resonator, which is then electromagnetically coupled to a vertical dielectric portion 105Y as an eighth-stage resonator. Finally, the vertical dielectric portion 105Y is magnetically coupled to the output loop 109, and the generated magnetic field is then output via a coaxial connector (unillustrated).

However, in the above conventional type of multi-stage dielectric filter shown in FIG. 6, the shape of the loops for coupling the TM110X mode generated in the horizontal dielectric portions, such as the coupling loops 107*a* and 107*d*, greatly differ from that of the loops for coupling the TM110Y mode generated in the vertical dielectric portions, such as the coupling loops 107*b* and 107*c*. This requires two types of molds for producing the above types of loops, thereby increasing the cost.

The above-mentioned increased cost particularly originates from the loops for coupling the vertical dielectric portions which are formed in a curved, complicated shape, in contrast to the simply shaped loops for coupling the horizontal dielectric portions. Further, the loops for coupling the vertical dielectric portions are easily deformed due to their complicated shape, which may disadvantageously change the coupling amount between the vertical dielectric portions, thereby further varying the filter characteristics.

Moreover, although the coupling loops 107*a* through 107*d* are mounted on the same panel 107, the input and output loops 108 and 109 are unable to be attached onto the panel 107 due to lack of space, since the loops 108 and 109 would otherwise overlap with the coupling loops 107*a* and 107*d*, respectively.

Additionally, the dielectric filter 101 has frequency adjustment means for each of the vertical dielectric portion and the horizontal dielectric portion of each TM double-mode dielectric resonator, and coupling control means for controlling the coupling coefficient between the vertical and horizontal dielectric portions (neither of these means are shown in FIG. 6). Generally, threaded metallic or dielectric rods are used as the frequency adjustment means and coupling control means.

The frequency adjustment means and the coupling-coefficient control means are mounted on the panel 106. More specifically, the above means for the TM double-mode dielectric resonator 102 are attached in the vicinity of the input loop 108, while the means for the resonator 105 are fixed in the vicinity of the output loop 109.

Consequently, when the frequency adjustment means and the coupling-coefficient control means provided near the input loop 108 are actuated, the coupling coefficient between the input loop 108 and the vertical dielectric portion 102Y may disadvantageously be changed. Likewise, when the frequency adjustment means and control means in the vicinity of the output loop 109 are actuated, the coupling coefficient between the output loop 109 and the vertical dielectric portion 105Y may unfavorably be changed.

SUMMARY OF THE INVENTION

Accordingly, it is a feature of the present invention to provide a dielectric filter or a dielectric duplexer in which coupling loops for coupling adjacent TM multi-mode dielectric resonators are formed in the same shape, thereby reducing the cost for the parts.

It is another feature of the present invention to provide a dielectric filter or a dielectric duplexer in which the coupling coefficients between the input loop and the TM multi-mode dielectric initial-stage resonator or between the output loop and the TM multi-mode dielectric final-stage resonator can remain unchanged, even when operating a frequency adjustment means for adjusting a frequency of a vertical dielectric portion or a horizontal dielectric portion of those resonators, or when actuating control means for controlling the coupling coefficient between the vertical and horizontal dielectric portions of those resonators.

In order to provide the above features, according to one aspect of the present invention, there is provided a dielectric filter comprising a plurality of TM multi-mode dielectric resonators, each of the dielectric resonators constructed with a cross-shaped dielectric member disposed in a cavity provided with openings, the dielectric resonators being aligned with the openings facing in the same direction, the dielectric resonators adjacent to each other being coupled, a mode generated in the horizontal direction of the cross-shaped dielectric member being defined as a TM110X mode, while a mode generated in the vertical direction of the dielectric member being defined as a TM110Y mode, wherein a TM110X+Y mode and a TM110X−Y mode, each of which is a mixture mode of the TM110X mode and the TM110Y mode, are alternately coupled to each other between the dielectric resonators adjacent to each other.

According to another aspect of the present invention, there is provided a dielectric duplexer comprising a plurality of dielectric filters, each of the filters having a plurality of TM multi-mode dielectric resonators, each of the dielectric resonators with a cross-shaped dielectric member is disposed in a cavity provided with openings, the dielectric resonators being aligned with the openings facing in the same direction, the dielectric resonators adjacent to each other being coupled, the plurality of dielectric filters comprising a first dielectric filter having a first frequency band and a second dielectric filter having a second frequency band; in each said resonator, a mode generated in the horizontal direction of the cross-shaped dielectric member being defined as a TM110X mode, while a mode generated in the vertical direction of the cross-shaped dielectric member being specified as a TM110Y mode, wherein a TM110X+Y mode and a TM110X−Y mode, each of which is a mixture mode of the TM110X mode and the TM110Y mode, are alternately coupled to each other between the dielectric resonators adjacent to each other.

In the dielectric duplexer constructed by connecting a plurality of dielectric filters, as well as in the single dielectric filter, the coupling means for coupling adjacent TM double-mode dielectric resonators can be placed obliquely to face the intersecting area between the vertical and horizontal dielectric portions of each dielectric resonator.

In the above dielectric duplexer, as well as in the single dielectric filter, the TM multi-mode dielectric resonator may be made into a TM triple-mode dielectric resonator in which the resonant frequency of a TM111 mode coincides with the resonant frequency of the TM110X+Y mode and the TM110X−Y mode, by forming a recessed portion in the dielectric resonator in a direction from the outer surface of the cavity to the longitudinal dielectric member. This makes it possible to use the single TM mode dielectric resonator as a three-stage resonator. Accordingly, in the dielectric duplexer, as well as in the aforedescribed dielectric filter, the single TM mode dielectric resonator can be employed as a three-stage resonator.

Further, in the dielectric duplexer, as well as in the single dielectric filter, a generally "V"-shaped coupling loop may be used for coupling adjacent TM multi-mode dielectric resonators. Thus, the coupling loop of the above type is easy to manufacture due to its simple shape.

BRIEF DESCRIPTION OF THE DRAWING

FIG. 2B illustrating an electric field of the TM 110X−Y mode;

FIG. 7B illustrating an electric field of the TM 110Y mode.

DESCRIPTION OF EMBODIMENTS OF THE INVENTION

A dielectric filter constructed in accordance with an embodiment of the present invention will now be described with reference to FIG. 1.

Figure 1:
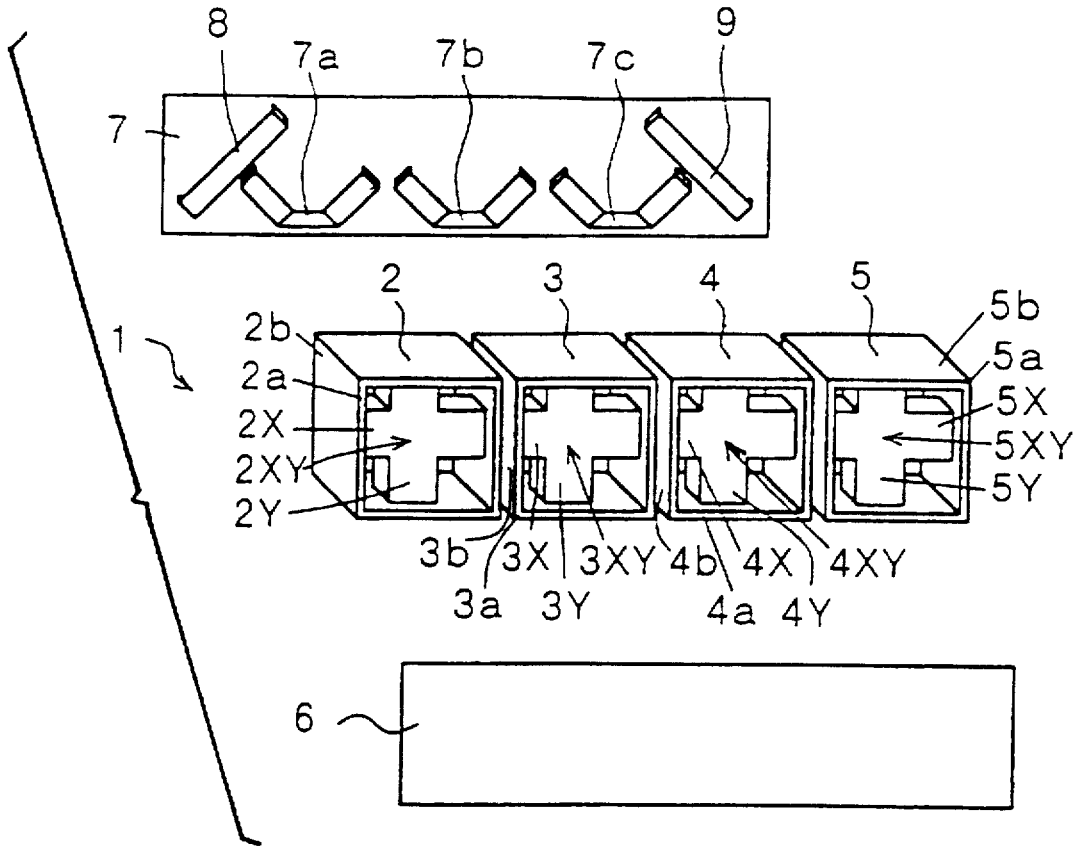
FIG. 1 is an exploded perspective view of a dielectric filter according to an embodiment of the present invention.

A dielectric filter generally indicated by 1 is constructed, as illustrated in FIG. 1, of four TM double-mode dielectric resonators 2, 3, 4 and 5 aligned in a row with their openings facing in the same direction, and metallic panels 6 and 7 attached to the resonators 2 through 5 by means such as screws or solder so as to cover the openings of the resonators 2 through 5. The panels 6 and 7 may be formed of ceramic plates or resin plates having conductors on their surfaces, but are preferably made of metal in consideration of workability and strength.

The TM double-mode dielectric resonator 2 is constructed in the following manner. A cavity 2*a* having openings at the forward and back ends and a cross-shaped dielectric member 2XY are integrally formed of the same dielectric material. A conductor 2*b* is disposed on the outer surfaces, except for the openings, of the cavity 2*a*. Conductors 2*b* may also be formed on the edges around the openings of the cavity 2*a*. The dielectric member 2XY is formed of a horizontal dielectric portion 2X and a vertical dielectric portion 2Y, so that the single TM double-mode dielectric resonator 2 can form a two-stage resonator. The TM double-mode dielectric resonators 3, 4 and 5 are constructed in a manner similar to the above-described dielectric resonator 2.

An input loop 8 and an output loop 9 are mounted on the panel 7 and connected to an external circuit via a coaxial connector (not shown). Also attached to the panel 7 are coupling loops 7*a*, 7*b* and 7*c* generally formed in a "V" shape for coupling adjacent TM double-mode dielectric resonators.

Disposed on the panel 6 are frequency adjustment means for each resonator and control means for controlling the coupling coefficient between the vertical and horizontal dielectric portions within the same dielectric member (neither of the means are shown in FIG. 1). As the above-mentioned adjustment means and control means, threaded dielectric or metallic rods are generally used. For mounting the adjustment means and control means, mating holes or threads may be formed in advance in the dielectric members of the resonators to receive the dielectric or metallic rods therein. A calibration window may be provided on the panel 6 through which an instrument may be inserted to operate the above adjustment and control means.

An explanation will now be given of the operation of the dielectric filter 1 constructed as described above.

Figure 2A:
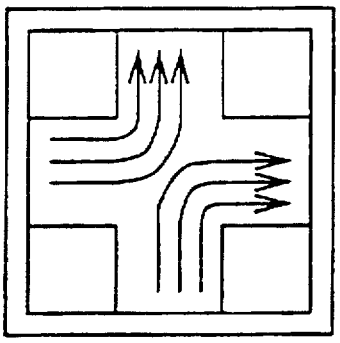
FIGS. 2A and 2B are schematic diagrams of a TM multi-mode dielectric resonator illustrating the operation of the dielectric filter shown in FIG. 1, FIG. 2A illustrating an electric field of the TM 110X+Y mode.
Figure 6:
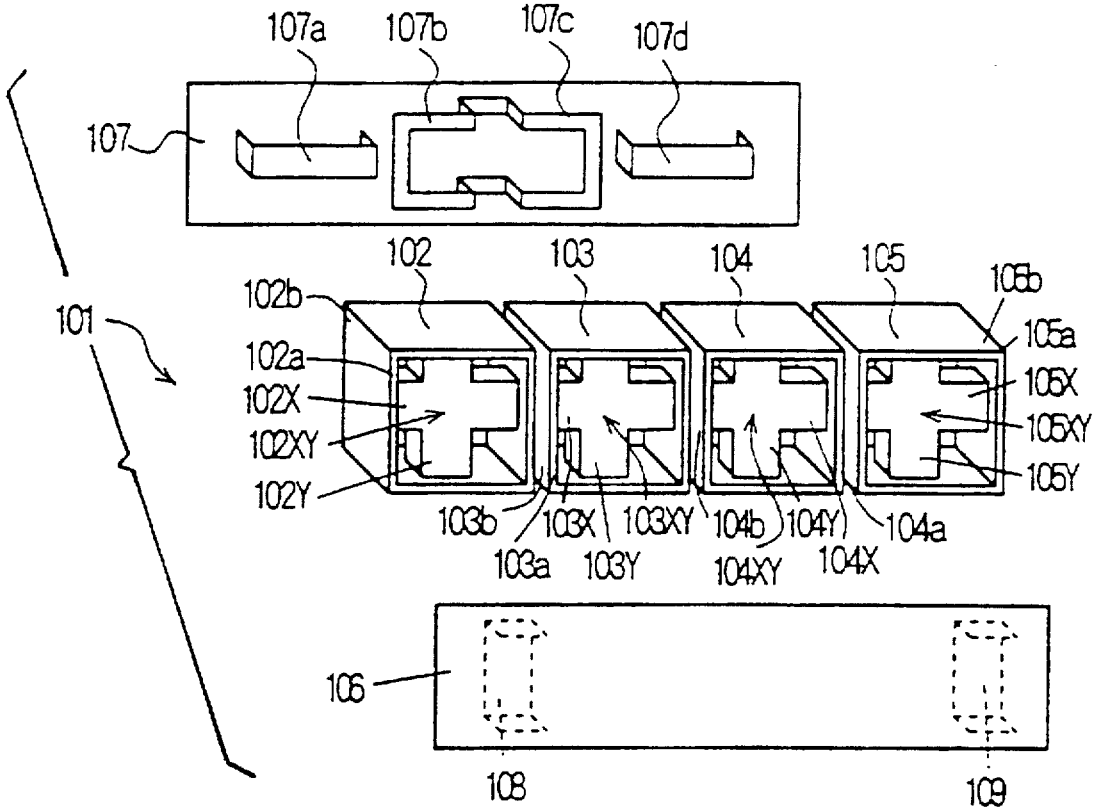
FIG. 6 PRIOR ART
FIG. 6 is an exploded perspective view of a conventional dielectric filter.
Figure 7A:
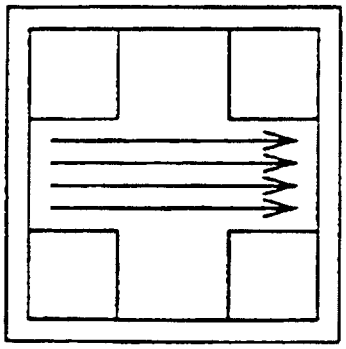
FIG. 7A PRIOR ART
FIGS. 7A and 7B are schematic diagrams of a TM double-mode dielectric resonator illustrating the operation of the known dielectric filter shown in FIG. 6, FIG. 7A illustrating an electric field of the TM 110X mode.
Figure 7B:
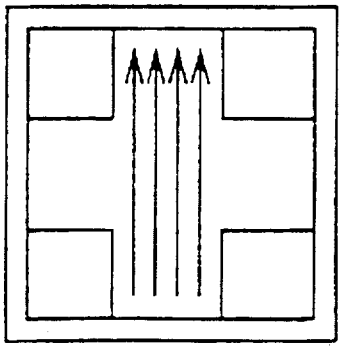
FIG. 7B PRIOR ART

High-frequency power is first supplied to the filter 1 to generate a magnetic field in the input loop 8. The generated magnetic field is overlapped with the intersecting area of the dielectric member 2XY of the first-stage dielectric resonator 2, thereby exciting a TM 110X+Y mode shown in FIG. 2A which crosses the magnetic field generated in the input loop 8. This TM 110X+Y mode is a mixture mode of the TM 110X mode and the TM 110Y mode shown in FIG. 6, which are excited in the horizontal dielectric portions and the vertical dielectric portions, respectively. In this embodiment, the TM 110X+Y mode generated in the dielectric member 2XY serves as an excitation mode of the first-stage resonator.

Figure 2B:
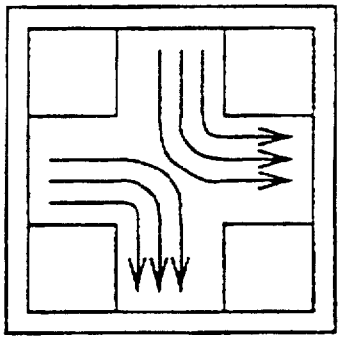

Then, the TM 110X+Y mode is electromagnetically coupled to a TM 110X−Y mode illustrated in FIG. 2B within the same dielectric member 2XY. The TM 110X−Y mode functions as an excitation mode of the second-stage resonator.

The magnetic field of the TM 110X−Y mode of the dielectric member 2XY is generated in a direction in which the magnetic field crosses electric lines of force indicated by the arrows shown in FIG. 2B. Accordingly, the TM 110X−Y mode crosses one end of the coupling loop 7*a*, but not the input loop 8 which is located parallel to the TM 110X−Y mode at a position facing the dielectric member 2XY. Hence, the TM 110X−Y mode generated in the dielectric member 2XY is magnetically coupled to the coupling loop 7*a* rather than the input loop 8.

The other end of the coupling loop 7*a* opposedly faces the intersecting area of the dielectric member 3XY of the TM double-mode dielectric resonator 3. Since the magnetic field produced in the coupling loop 7*a* is overlapped with the intersecting area of the dielectric member 3XY of the second resonator 3, the TM 110X+Y mode crossing this magnetic field is excited. The TM 110X+Y mode generated in the dielectric member 3XY of the resonator 3 serves as an excitation mode of the third-stage resonator. Further, the TM 110X+Y mode is electromagnetically coupled to the TM 110X−Y mode in the same dielectric member 3XY of the resonator 3.

Thereafter, in a manner similar to the above procedure, the TM 110X−Y mode generated in the dielectric member 3XY of the second resonator 3 is magnetically coupled to one end of the coupling loop 7*b*, and is further magnetically coupled to the TM 110X+Y mode generated in the other end of the coupling loop 7*b* and the dielectric member 4XY of the third dielectric resonator 4. The TM 110X+Y mode created in the dielectric member 4XY of the resonator 4 is electromagnetically coupled to the TM 110X−Y mode within the same dielectric member 4XY. The TM 110X−Y mode is magnetically coupled to one end of the coupling loop 7*c* within the dielectric member 4XY of the resonator 4, and is further magnetically coupled to the TM 110X+Y mode generated in the other end of the coupling loop 7*c* and the dielectric member 5XY of the fourth dielectric resonator 5. The TM 110X+Y mode created in the dielectric member 5XY of the resonator 5 is electromagnetically coupled to the TM 110X−Y mode within the same dielectric member 5XY. The TM 110X−Y mode generated in the dielectric member 5XY is magnetically coupled to the output loop 9 and is output via a coaxial connector (unillustrated).

In this embodiment, the resonator using the TM 110X+Y mode generated in the dielectric member 2XY of the resonator 2 as an excitation mode serves as a first-stage resonator. However, the order of stages may be reversed. More specifically, the output loop 9 shown in FIG. 1 may be used as the input loop. In this case, high-frequency power is supplied to the output loop 9 and the resulting mode is output through the input loop 8 used as the output loop in such a manner that the resonator using the TM 110X−Y mode generated in the dielectric member 5XY of the TM double-mode dielectric resonator 5 as an excitation mode may be employed as a first-stage resonator.

A description will now be given of a dielectric filter according to another embodiment of the present invention while referring to FIG. 3.

A dielectric filter generally designated by 11 is constructed in a manner similar to the filter 1 shown in FIG. 1 in the following points. The filter 11 has, as illustrated in FIG. 3, four TM mode dielectric resonators 12, 13, 14 and 15 aligned in a row with their openings facing in the same direction, and metallic panels 16 and 17 attached to the resonators 12 through 15 by means such as screws or solder so as to cover the openings of the resonators 12 through 15. Further, an input loop 18, an output loop 19, and coupling loops 17*a*, 17*b* and 17*c* are located on the panel 17.

Figure 3:
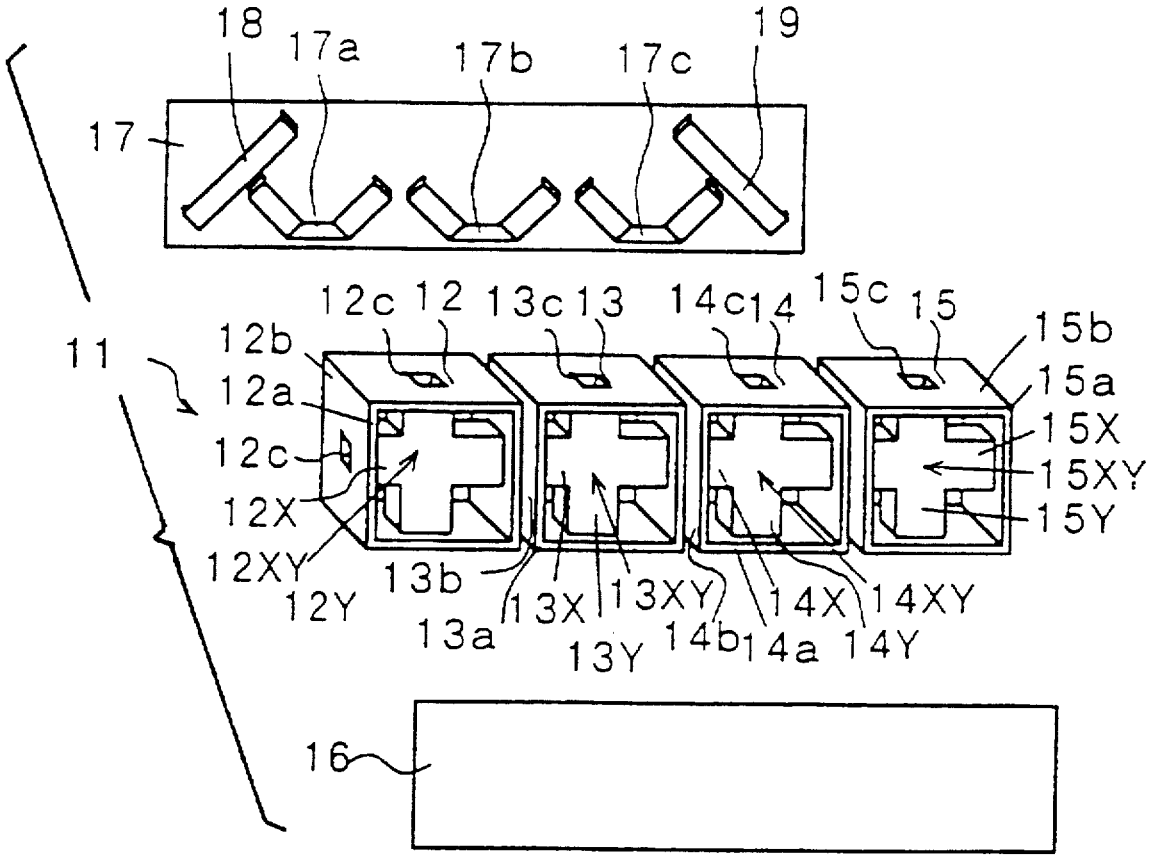
FIG. 3 is an exploded perspective view of a dielectric filter according to another embodiment of the present invention.

However, the dielectric filter 11 shown in FIG. 3 differs from the filter 1 shown in FIG. 1 in the structure of the TM mode dielectric resonators used in the filter.

More specifically, the TM mode dielectric resonator 12 is constructed in the following manner. A cavity 12*a* having openings at the forward and back ends and a cross-shaped dielectric member 12XY are integrally formed of the same dielectric material. A conductor 12*b* is disposed on the outer surfaces, except for the openings, of the cavity 12*a*. Conductors 12*b* may also be formed on edges around the openings of the cavity 12*a*. The dielectric member 12XY is formed of a horizontal dielectric portion 12X and a vertical dielectric portion 12Y. Recessed portions 12*c* are formed, as shown in FIG. 3, at the four areas where the cavity 12*a* and the dielectric member 12XY are joined in a direction from the outer surface of the cavity 12*a* to the longitudinal dielectric member 12XY. The conductor 12*b* is continuously disposed on the inner surfaces of the recessed portion 12*c*.

Figure 4:
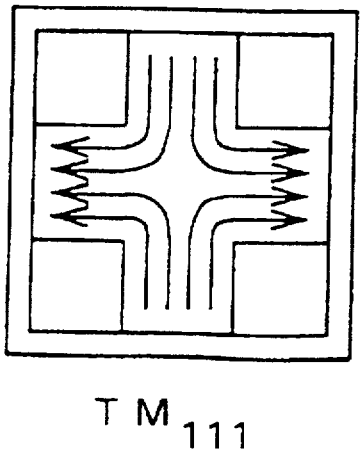
FIG. 4 represents an electric field of a TM 111 mode generated in a TM multi-mode dielectric resonator to illustrate the operation of the dielectric filter shown in FIG. 3.

With this construction, as indicated in FIG. 4, the TM 111 mode, which was originally an unwanted mode, can be utilized as well as the TM 110X+Y mode and the TM 110X−Y mode because the resonant frequency of the TM 111 mode is positioned in the same pass band as the TM 110X+Y mode and the TM 110X−Y mode. Accordingly, the single TM mode dielectric resonator 12 is able to form a three-stage resonator. The TM mode dielectric resonators 13, 14 and 15 are constructed in a manner similar to the above-described dielectric resonator 12.

An explanation will now be given of the operation of the dielectric filter 11 constructed as described above.

High-frequency power is first supplied to the dielectric filter 11 to generate a magnetic field in the input loop 18. The generated magnetic field is coupled to the TM 110X+Y mode generated in the dielectric member 12XY of the first dielectric resonator 12. This TM 110X+Y mode serves as an excitation mode of a first-stage resonator. Then, the second-stage TM 111 mode and the third-stage TM 110X−Y mode are excited within the same dielectric member 12XY.

The magnetic field of the third-stage TM 110X−Y mode is coupled to the fourth-stage TM 110X+Y mode of the dielectric member 13XY via the coupling loop 17*a*, thereby sequentially exciting the fifth-stage TM 111 mode and the sixth-stage TM 110X−Y mode in the same dielectric member 13XY. Likewise, in each of the TM double-mode dielectric resonators 14 and 15, the TM 110X+Y mode, the TM 111 mode, and the TM 110X−Y mode are sequentially coupled in the above-given order. In this manner, the dielectric filter 11 formed of 12 stages of resonators is constructed.

A dielectric duplexer constructed in accordance with a further embodiment of the present invention will now be described with reference to FIG. 5.

Figure 5:
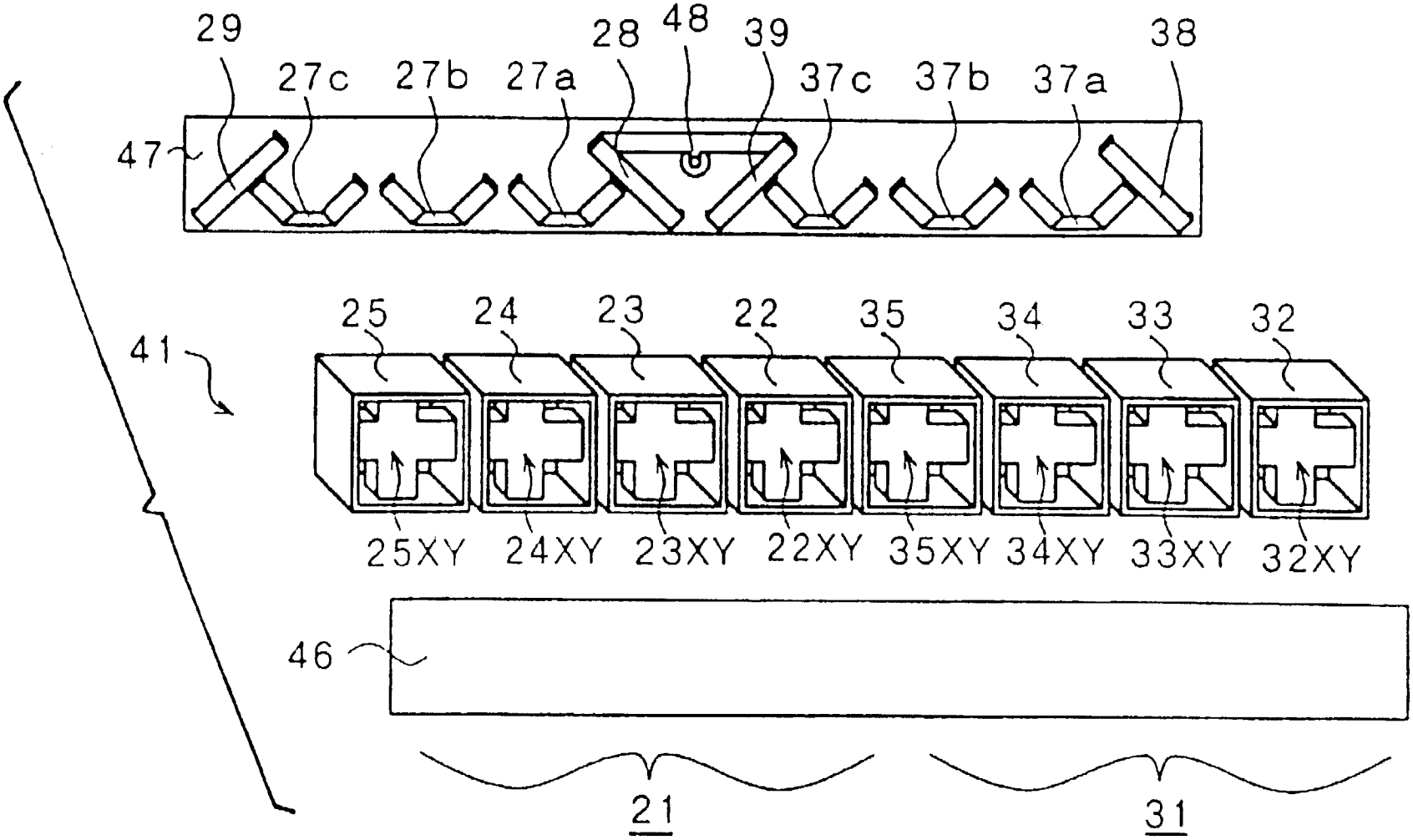
FIG. 5 is an exploded perspective view of a dielectric duplexer according to a further embodiment of the present invention.

A dielectric duplexer generally represented by 41 is constructed, as illustrated in FIG. 5, of a receiving dielectric filter 21, a transmitting dielectric filter 31, and metallic panels 46 and 47.

TM double-mode dielectric resonators 22, 23, 24 and 25 of the receiving dielectric filter 21 and TM double-mode dielectric resonators 32, 33, 34 and 35 of the transmitting dielectric filter 31 are aligned in a row with their openings facing in the same direction. Further, the panels 46 and 47 are attached to the resonators 22 through 25 and 32 through 35 to cover their openings by means such as screws or solder.

The receiving dielectric filter 21, formed of the four dielectric resonators 22, 23, 24 and 25, has a fixed frequency pass band that coincides with certain receiving signals. The transmitting dielectric filter 31, constructed of the four dielectric resonators 32, 33, 34 and 35, also has a fixed frequency pass band which matches certain transmitting signals. It should be noted that the frequency pass band of the transmitting dielectric filter 31 is different from that of the receiving dielectric filter 21.

The TM double-mode dielectric resonators 22 through 25 and 32 through 35 are constructed in a manner similar to the dielectric resonator 2 shown in FIG. 1, and a detailed explanation thereof will thus be omitted.

Mounted on the panel 47 are a receiving input loop 28, a receiving output loop 29, a transmitting input loop 38, and a transmitting output loop 39. The receiving input loop 28 and the transmitting output loop 39 are coupled to each other via an antenna loop 48. The loops 28 and 39 are also coupled to a coaxial connector (not shown) via the antenna loop 48, and are thus connected to an external antenna. In this embodiment, the receiving input loop 28, the transmitting output loop 39, and the antenna loop 48 are formed by bending a sheet of metallic plate. Further, the receiving output loop 29 and the transmitting input loop 38 are each connected to an external circuit via a coaxial connector (unillustrated). Also attached to the panel 47 are receiving coupling loops 27*a*, 27*b* and 27*c* and transmitting coupling loops 37*a*, 37*b* and 37*c*, all of which are generally formed in a "V" shape.

Moreover, provided on the panel 46 are frequency adjustment means for each resonator of the receiving and transmitting dielectric filters 21 and 31, and control means for controlling the coupling coefficient between the horizontal and vertical dielectric portions (two resonators) within the same dielectric member (neither of the means are shown in FIG. 5). As the adjustment and control means for the dielectric duplexer 41, dielectric or metallic rods or a calibration window may be used, as in the case with the dielectric filter 1 shown in FIG. 1.

The operation of the aforedescribed dielectric duplexer 41 will now be explained.

A receiving signal is first input through an antenna. The input receiving signal is then transmitted to the receiving input loop 28 via the antenna loop 48. Simultaneously, although the receiving signal is also transmitted to the transmitting output loop 39, the frequency band of the receiving signal differs from that of the transmitting dielectric filter 31, thereby rendering the filter 31 inoperable.

The receiving input loop 28 is magnetically coupled to the TM 110X−Y mode generated in the dielectric member 22XY of the receiving dielectric resonator 22. The TM 110X−Y mode is then electromagnetically coupled to the TM 110X+Y mode within the dielectric member 22XY of the resonator 22. Further, the TM 110X+Y mode of the dielectric member 22XY is magnetically coupled to the TM 110X−Y mode of the dielectric member 23XY of the dielectric resonator 23 via the coupling loop 27*a*. The TM 110X−Y mode is then electromagnetically coupled to the TM 110X+Y mode within the dielectric member 23XY of the resonator 23.

Likewise, thereafter, the dielectric resonator 23 is coupled via the coupling loop 27*b* to the resonator 24, which is then coupled to the resonator 25 via the coupling loop 27*c*. The resonator 25 is further coupled to the receiving output loop 29. As a consequence, the selected receiving signal is output from the receiving dielectric filter 21.

In contrast, a transmitting signal input into the transmitting input loop 38 is radiated from an antenna (not shown) through the dielectric resonator 32, the coupling loop 37*a*, the dielectric resonator 33, the coupling loop 37*b*, the dielectric resonator 34, the coupling loop 37*c*, the dielectric resonator 35, the output loop 39, and the antenna loop 48 in the above-given order.

In the aforedescribed embodiments, the dielectric filters 1 and 11 respectively shown in FIGS. 1 and 3, and the dielectric duplexer 41 illustrated in FIG. 5 are constructed of TM multi-mode dielectric resonators and panels. If, however, it is necessary to increase the strength of the parts, the filters 11 and 11 and the duplexer 41 may be accommodated in a conductive case.

Additionally, to make the ground potentials of adjacent dielectric resonators consistent, a metallic plate or a conductive plate formed by disposing a conductor on the surface of an insulator may be bridged over the conductors formed on the surfaces of the cavities of the adjacent dielectric resonators.

As will be clearly understood from the foregoing description, the present invention offers the following advantages.

A mixture mode of two different excitation modes of vertical dielectric portions and horizontal dielectric portions, respectively, of TM multi-mode dielectric resonators is employed as a fundamental mode in the dielectric filter or the dielectric duplexer of the present invention. Accordingly, the coupling means can be positioned obliquely to the intersecting area between the vertical and horizontal dielectric portions of the dielectric resonators. Thus, the arrangement and the structure of the coupling loops can be made simple. By virtue of the above-described positioning of the coupling loops, the input loop and the output loop can be disposed on the same panel as the coupling loops. This further makes it possible to attach all of the coupling loops, the input loop and the output loop to a panel different from the panel provided with the frequency adjustment means and the coupling-coefficient control means. Hence, the coupling coefficients of the input and output loops can remain unchanged even when the frequency adjustment means or the coupling-coefficient control means are activated. Similarly, unwanted changes in the coupling coefficient between adjacent TM multi-mode dielectric resonators can also be inhibited when the frequency adjustment means or the coupling-coefficient control means are operated. As a consequence, the overall filter characteristics can be substantially maintained.

Further, a dielectric filter constructed by using TM triple-mode dielectric resonators can be downsized to two-thirds the size of a filter using TM double-mode dielectric resonators.

Additionally, coupling loops generally formed in a "V" shape employed in the dielectric filter are easily manufactured by bending a piece of a metallic strip.

What is claimed is:

1. A dielectric filter, comprising:

a plurality of TM multi-mode dielectric resonators disposed in series next to one another in a first direction; and a plurality of coupling elements providing coupling between adjacent dielectric resonators, each of said dielectric resonators including a cross-shaped dielectric member disposed in a cavity provided with openings oriented in a second direction different from the first direction, wherein a mode generated in the horizontal direction of said cross-shaped dielectric member is defined as a TM 110X mode, while a mode generated in the vertical direction of said dielectric member is defined as a TM 110Y mode, and a TM 110X+Y mode and a TM 110X−Y mode, each of which is a mixture mode of the TM 110X mode and the TM 110Y mode, are alternately coupled to each other between adjacent dielectric resonators via said coupling elements.

2. A dielectric filter according to claim 1, wherein at least one of said TM multi-mode dielectric resonators comprises a TM triple-mode dielectric resonator in which the resonant frequency of a TM 111 mode coincides with the resonant frequency of the TM 110X+Y mode and the TM 110X−Y mode, the TM triple-mode dielectric resonator includes a recessed portion extending in a direction from an outer surface of said cavity to the dielectric member of said at least one of said TM multi-mode dielectric resonators.

3. A dielectric filter according to claim 2, wherein said coupling elements include at least one substantially "V"-shaped coupling loop arranged in said dielectric filter for providing coupling between at least some of said plurality of TM multi-mode dielectric resonators.

4. A dielectric filter according to claim 1, (further comprising a generally) wherein said coupling elements include at least one substantially "V"-shaped coupling loop arranged in said dielectric filter for providing coupling between at least some of said plurality of TM multi-mode dielectric resonators.

5. A dielectric duplexer, comprising:

plurality of dielectric filters, each of said filters having a plurality of TM multi-mode dielectric resonators disposed in series next to one another in a first direction, each of said dielectric resonators including a cross-shaped dielectric member disposed in a cavity provided with openings oriented in a second direction different from the first direction; and a plurality of coupling elements providing coupling between adjacent dielectric resonators;

said plurality of dielectric filters comprising:

a first dielectric filter having a first frequency band and a second dielectric filter having a second frequency band;

in each said dielectric resonator, a mode generated in the horizontal direction of said cross-shaped dielectric member being defined as a TM110X mode, while a mode generated in the vertical direction of said cross-shaped dielectric member being specified as a TM110Y mode, wherein a TM110X+Y mode and a TM110X−Y mode, each of which is a mixture mode of the TM110X mode and the TM110Y mode, are alternately coupled to each other between adjacent dielectric resonators via said coupling elements.

6. A dielectric duplexer according to claim 5, wherein at least one of said TM multi-mode dielectric resonators comprises a TM triple-mode dielectric resonator in which the resonant frequency of a TM 111 mode coincides with the resonant frequency of the TM 110X+Y mode and the TM 110X−Y mode, the TM triple-mode dielectric resonator includes a recessed portion in said dielectric resonator extending in a direction from an outer surface of said cavity to the dielectric member of said at least one of said TM multi-mode dielectric resonators.

7. A dielectric duplexer according to claim 6, wherein said coupling elements include at least one substantially "V"-shaped coupling loop arranged in said dielectric filter for providing coupling between at least some of said plurality of TM multi-mode dielectric resonators.

8. A dielectric duplexer according to claim 5, wherein said coupling elements include at least one substantially "V"-shaped coupling loop arranged in said dielectric filter for providing coupling between at least some of said plurality of TM multi-mode dielectric resonators.

9. A dielectric filter according to claim 1, wherein said second direction is transverse to said first direction.

10. A dielectric filter according to claim 1, wherein said second direction is substantially perpendicular to said first direction.

11. A dielectric duplexer according to claim 5, wherein said second direction is transverse to said first direction.

12. A dielectric duplexer according to claim 5, wherein said second direction is substantially perpendicular to said first direction.

13. A dielectric filter, comprising:

a plurality of TM multi-mode dielectric resonators, each of said dielectric resonators including a cavity provided with openings and a cross-shaped dielectric member disposed in said cavity and aligned with the openings facing in the same direction; and a plurality of coupling elements providing coupling between adjacent dielectric resonators, wherein:

a mode generated in the horizontal direction of said cross-shaped dielectric member is defined as a TM 110X mode, while a mode generated in the vertical direction of said dielectric member is defined as a TM 110Y mode;

a TM 110X+Y mode and a TM 110X−Y mode, each of which is a mixture mode of the TM 110X mode and the TM 110Y mode, are alternately coupled to each other between adjacent dielectric resonators via said coupling elements; and at least one of said TM multi-mode dielectric resonators comprises a TM triple-mode dielectric resonator in which the resonant frequency of a TM 111 mode coincides with the resonant frequency of the TM 110X+Y mode and the TM 110X−Y mode, the TM triple-mode dielectric resonator includes a recessed portion extending in a direction from an outer surface of said cavity to the dielectric member of said at least one of said TM multi-mode dielectric resonators.

14. A dielectric filter according to claim 13, wherein said plurality of TM multi-mode dielectric resonators are disposed in series next to one another in a first direction and said openings of said cavities are oriented in a second direction different from the first direction.

15. A dielectric filter according to claim 14, wherein said second direction is transverse to said first direction.

16. A dielectric filter according to claim 14, wherein said second direction is substantially perpendicular to said first direction.

17. A dielectric filter according to claim 13, wherein said coupling elements include at least one substantially V-shaped coupling loop arranged in said dielectric filter for providing coupling between at least some of said plurality of TM multi-mode dielectric resonators.

18. A dielectric duplexer, comprising:

a plurality of dielectric filters, each of said filters having a plurality of TM multi-mode dielectric resonators, each of said dielectric resonators including a cavity provided with openings and a cross-shaped dielectric member disposed in said cavity and aligned with the openings facing in the same direction; and a plurality of coupling elements providing coupling between adjacent dielectric resonators;

said plurality of dielectric filters comprising a first dielectric filter having a first frequency band and a second dielectric filter having a second frequency band, wherein:

in each said dielectric resonator, a mode generated in the horizontal direction of said cross-shaped dielectric member is defined as a TM110X mode and a mode generated in the vertical direction of said cross-shaped dielectric member is defined as a TM110Y mode;

a TM110X+Y mode and a TM110X−Y mode, each of which is a mixture mode of the TM110X mode and the TM110Y mode, are alternately coupled to each other between adjacent dielectric resonators via said coupling elements; and at least one of said TM multi-mode dielectric resonators comprises a TM triple-mode dielectric resonator in which the resonant frequency of a TM 111 mode coincides with the 25 resonant frequency of the TM 110X+Y mode and the TM 110X−Y mode, the TM triple-mode dielectric resonator includes a recessed portion in said dielectric resonator extending in a direction from an outer surface of said cavity to the dielectric member of said at least one of said TM multi-mode dielectric resonators.

19. A dielectric duplexer according to claim 18, wherein said plurality of TM multi-mode dielectric resonators are disposed in series next to one another in a first direction and said openings of said cavities are oriented in a second direction different from the first direction.

20. A dielectric duplexer according to claim 19, wherein said second direction is transverse to said first direction.

21. A dielectric duplexer according to claim 19, wherein said second direction is substantially perpendicular to said first direction.

22. A dielectric duplexer according to claim 18, wherein said coupling elements include at least one substantially V-shaped coupling loop arranged in said dielectric filter for providing coupling between at least some of said plurality of TM multi-mode dielectric resonators.

* * * * *